US011499239B2

(12) United States Patent
Park et al.

(10) Patent No.: US 11,499,239 B2
(45) Date of Patent: Nov. 15, 2022

(54) ANODE FOR ELECTROLYSIS AND PREPARATION METHOD THEREOF

(71) Applicant: LG CHEM, LTD., Seoul (KR)

(72) Inventors: Hun Min Park, Daejeon (KR); Jung Ho Choi, Daejeon (KR); In Sung Hwang, Daejeon (KR); Kwang Hyun Kim, Daejeon (KR); Jung Up Bang, Daejeon (KR); Dong Chul Lee, Daejeon (KR); Gyo Hyun Hwang, Daejeon (KR)

(73) Assignee: LG Chem, Ltd., Seoul (KR)

( * ) Notice: Subject to any disclaimer, the term of this patent is extended or adjusted under 35 U.S.C. 154(b) by 0 days.

(21) Appl. No.: 16/959,584

(22) PCT Filed: Jun. 4, 2019

(86) PCT No.: PCT/KR2019/006754
§ 371 (c)(1),
(2) Date: Jul. 1, 2020

(87) PCT Pub. No.: WO2019/240421
PCT Pub. Date: Dec. 19, 2019

(65) Prior Publication Data

US 2020/0385876 A1 Dec. 10, 2020

(30) Foreign Application Priority Data

Jun. 12, 2018 (KR) ..... 10-2018-0067656

(51) Int. Cl.

| | |
|---|---|
| ***C25B 11/04*** | (2021.01) |
| ***C25B 11/075*** | (2021.01) |
| ***B05D 1/04*** | (2006.01) |
| ***B05D 3/00*** | (2006.01) |
| ***B05D 3/02*** | (2006.01) |
| ***B05D 3/10*** | (2006.01) |
| ***C25B 1/34*** | (2006.01) |
| ***C25B 11/051*** | (2021.01) |

(52) U.S. Cl.
CPC ..... *C25B 11/075* (2021.01); *B05D 1/04* (2013.01); *B05D 3/002* (2013.01); *B05D 3/0254* (2013.01); *B05D 3/10* (2013.01); *B05D 3/102* (2013.01); *C25B 1/34* (2013.01); *C25B 11/051* (2021.01)

(58) Field of Classification Search
CPC ..... B05D 1/04; B05D 3/002; B05D 3/10
See application file for complete search history.

(56) References Cited

U.S. PATENT DOCUMENTS

| | | | | |
|---|---|---|---|---|
| 3,711,385 | A | 1/1973 | Beer et al. | |
| 4,495,048 | A | 1/1985 | Murakami et al. | |
| 2004/0188247 | A1 | 9/2004 | Hardee | |
| 2013/0186750 | A1 | 7/2013 | Urgeghe et al. | |
| 2013/0334037 | A1* | 12/2013 | Haneda | C25B 11/097 204/290.09 |

FOREIGN PATENT DOCUMENTS

| | | | |
|---|---|---|---|
| CN | 1764743 | A | 4/2006 |
| CN | 101111631 | A | 1/2008 |
| CN | 103210122 | A | 7/2013 |
| CN | 103261485 | A | 8/2013 |
| EP | 1841901 | A1 | 10/2007 |
| KR | 10-2005-0111614 | A | 11/2005 |
| KR | 10-2007-0099667 | A | 10/2007 |
| KR | 10-201100094055 | A | 8/2011 |
| KR | 10-2014-0009211 | A | 1/2014 |
| KR | 10-2017-0075528 | A | 7/2017 |
| WO | 2005-033367 | A1 | 4/2005 |

* cited by examiner

*Primary Examiner* — Nathan T Leong
(74) *Attorney, Agent, or Firm* — Dentons US LLP

(57) ABSTRACT

Provided are an anode for electrolysis, which includes a metal base, and a catalyst layer disposed on at least one surface of the metal base, wherein the catalyst layer includes a composite metal oxide of ruthenium, iridium, titanium, and platinum, and a metal in the composite metal oxide does not include palladium, wherein, when the catalyst layer is equally divided into a plurality of pixels, a standard deviation of iridium compositions of the plurality of equally divided pixels is 0.40 or less, and a method of preparing the same.

7 Claims, No Drawings

ANODE FOR ELECTROLYSIS AND PREPARATION METHOD THEREOF

CROSS-REFERENCE TO RELATED APPLICATIONS

This application is a National Phase Application of International Application No. PCT/KR2019/006754 filed on Jun. 4, 2019, which claims the benefit of priority of Korean Patent Application No. 10-2018-0067656, filed on Jun. 12, 2018, in the Korean Intellectual Property Office, the disclosures of which are incorporated herein by reference in their entirety.

TECHNICAL FIELD

The present invention relates to an anode for electrolysis and a method of preparing the same, and more particularly, to an anode for electrolysis having reduced overvoltage and improved lifetime while exhibiting high efficiency and a method of preparing the same.

BACKGROUND ART

Techniques for producing hydroxides, hydrogen, and chlorine by electrolysis of low-cost brine, such as sea water, are widely known. Such an electrolysis process is also called a chlor-alkali process, and can be referred to as a process that has already proven its performance and technical reliability in commercial operation for several decades.

With respect to the electrolysis of brine, an ion exchange membrane method, in which an ion exchange membrane is installed in an electrolytic bath to divide the electrolytic bath into a cation chamber and an anion chamber and brine is used as an electrolyte to obtain chlorine gas at an anode and hydrogen and caustic soda at a cathode, is currently the most widely used method.

The electrolysis of brine is performed by reactions as shown in the following electrochemical reaction formulae.

Anodic reaction: $2Cl^- \rightarrow Cl_2 + 2e^-$ ($E^0 = +1.36\ V$)

Cathodic reaction: $2H_2O + 2e^- \rightarrow 2OH^- + H_2$ ($E^0 = -0.83\ V$)

Total reaction: $2Cl^- + 2H_2O \rightarrow 2OH^- + Cl_2 + H_2$ ($E^0 = -2.19\ V$)

In the electrolysis of brine, an overvoltage of the anode, an overvoltage of the cathode, a voltage due to resistance of the ion exchange membrane, and a voltage due to a distance between the anode and the cathode must be considered for an electrolytic voltage in addition to a theoretical voltage required for brine electrolysis, and the overvoltage caused by the electrode among these voltages is an important variable.

Thus, methods capable of reducing the overvoltage of the electrode have been studied, wherein, for example, a noble metal-based electrode called a DSA (Dimensionally Stable Anode) has been developed and used as the anode and development of an excellent material having durability and low overvoltage is required for the cathode.

Currently, an anode having a catalyst layer including a composite oxide of ruthenium (Ru), iridium (Ir), and titanium (Ti) is the most widely used in commercial brine electrolysis, and the anode is advantageous in that it exhibits excellent chlorine generating reaction activity and stability, but it consumes a lot of energy during operation due to a high overvoltage and life characteristics are not excellent.

Therefore, there is a need to develop an anode having reduced overvoltage and improved lifetime as well as excellent chlorine generating reaction activity and stability in order for the anode to be applied to the commercial brine electrolysis.

PRIOR ART DOCUMENT

Patent Document (Patent Document 1) KR 2011-0094055 A

DISCLOSURE OF THE INVENTION

Technical Problem

An aspect of the present invention provides an anode for electrolysis having reduced overvoltage and improved lifetime while exhibiting high efficiency and a method of preparing the same.

Technical Solution

According to an aspect of the present invention, there is provided an anode for electrolysis which includes a metal base, and a catalyst layer disposed on at least one surface of the metal base, wherein the catalyst layer includes a composite metal oxide of ruthenium, iridium, titanium, and platinum, and a metal in the composite metal oxide does not include palladium, wherein, when the catalyst layer is equally divided into a plurality of pixels, a standard deviation of iridium compositions of the plurality of equally divided pixels is 0.40 or less.

According to another aspect of the present invention, there is provided a method of preparing the anode for electrolysis which includes a coating step in which a composition for forming a catalyst layer is coated on at least one surface of a metal base, dried, and heat-treated, wherein the coating is conducted by electrostatic spray deposition, and the composition for forming a catalyst layer includes a ruthenium-based compound, an iridium-based compound, a titanium-based compound, and a platinum-based compound.

Advantageous Effects

Since an anode for electrolysis according to the present invention is prepared by electrostatic spray deposition, an active material can be uniformly distributed in a catalyst layer. Thus, an overvoltage of the anode can be reduced and lifetime can be improved while exhibiting high efficiency during electrolysis. Also, the generation of oxygen at the anode during electrolysis can be suppressed.

Furthermore, since a method of preparing an anode for electrolysis according to the present invention uses electrostatic spray deposition when coating a metal base with a composition for forming a catalyst layer, the composition for forming a catalyst layer can be uniformly distributed on an entire surface of the metal base, and thus, an anode for electrolysis can be prepared in which the active material is uniformly distributed in the catalyst layer.

MODE FOR CARRYING OUT THE INVENTION

Hereinafter, the present invention will be described in more detail to allow for a clearer understanding of the present invention.

It will be understood that words or terms used in the specification and claims shall not be interpreted as the meaning defined in commonly used dictionaries. It will be further understood that the words or terms should be interpreted as having a meaning that is consistent with their meaning in the context of the relevant art and the technical idea of the invention, based on the principle that an inventor can properly define the meaning of the words or terms to best explain the invention.

1. Anode for Electrolysis

An anode for electrolysis according to an embodiment of the present invention includes a metal base, and a catalyst layer disposed on at least one surface of the metal base, wherein the catalyst layer includes a composite metal oxide of ruthenium, iridium, titanium, and platinum, and a metal in the composite metal oxide does not include palladium, wherein when the catalyst layer is equally divided into a plurality of pixels, a standard deviation of iridium compositions of the plurality of equally divided pixels is 0.4 or less.

The standard deviation of the iridium compositions can be 0.30 or less, for example, 0.25 or less.

The standard deviation of the iridium compositions denotes uniformity of an active material in the catalyst layer, that is, a degree to which the active material is uniformly distributed in the catalyst layer, wherein the small standard deviation of the iridium compositions means that the uniformity of the active material in the catalyst layer is excellent. In a case in which the active material is not uniformly distributed, since the flow of electrons in the electrode is concentrated to a region with low resistance, etching can be rapidly performed from a region having a thin catalyst layer. Also, since electrons penetrate into pores in the catalyst layer, deactivation can proceed rapidly and electrode life can be shortened. Furthermore, since a concentration of an anodic electrolyte is decreased around the region where the flow of electrons is concentrated, oxygen selectivity can be increased and overvoltage can be increased due to the non-uniform current distribution. In addition, since a load of a separator is non-uniform during a cell operation as the flow of electrons is concentrated, performance and durability of the separator can be degraded.

Herein, the anode for electrolysis is equally divided into a plurality of pixels, a wt % of iridium in each equally divided pixel is measured, and the standard deviation of the iridium compositions is calculated by substituting the measured value into the following equation.

Specifically, the anode for electrolysis is fabricated to have a size of 1.2 m in length and 1.2 m in width (length× width=1.2 m×1.2 m), it is equally divided into 9 pixels, and a wt % of iridium in each pixel is then measured using an X-ray fluorescence (XRF) analyzer. Thereafter, dispersion (V(x)) is obtained by the following Equation 1 using each iridium wt % measured, and a standard deviation (o) is calculated by the following Equation 2 using the dispersion.

$$V(x)=E(x^2)-[E(x)]^2 \quad \text{[Equation 1]}$$

$$\sigma=\sqrt{V(x)} \quad \text{[Equation 2]}$$

In Formula 1, $E(x^2)$ is a mean value of squared wt % of iridium in the 9 pixels, and $[E(x)]^2$ is a squared value of mean wt % of iridium in the 9 pixels.

A "standard deviation value of the iridium compositions" with respect to a "mean value of the iridium compositions" of each equally divided pixel (standard deviation/mean) can be in a range of 0.05 to 0.15, for example, 0.06 to 0.12. Herein, units are omitted.

When the above-described range is satisfied, since coating of the electrode is uniform, electrode performance is stable and durability becomes excellent.

An average wt % of the iridium compositions of each equally divided pixel can be in a range of 1.5 wt % to 4 wt %, for example, 2 wt % to 3.5 wt %.

When the above-described range is satisfied, the electrode performance and durability are improved while maintaining a reasonable coating cost.

The anode for electrolysis can contain 7.0 g or more, for example, 7.5 g or more of ruthenium per unit area ($m^2$) of the catalyst layer.

When the above-described amount is satisfied, an overvoltage of the anode can be significantly reduced during electrolysis.

The metal base can include titanium, tantalum, aluminum, hafnium, nickel, zirconium, molybdenum, tungsten, stainless steel, or an alloy thereof, and, among these metals, the metal base can preferably include titanium.

A shape of the metal base can be a rod, sheet, or plate shape, and the metal base can have a thickness of 50 μm to 500 μm, wherein the shape and thickness of the metal base are not particularly limited as long as the metal base can be used in an electrode generally used in a chlor-alkali electrolysis process, and the shape and thickness of the metal base can be suggested as an example.

The platinum included in the composite metal oxide can improve an overvoltage phenomenon of the anode during electrolysis, durability of the anode, and stability of the catalyst layer. Also, the platinum can suppress generation of oxygen at the anode during electrolysis.

The composite metal oxide can include a total amount of the ruthenium, iridium, and titanium to the amount of platinum in a molar ratio of 98:2 to 80:20 or 95:5 to 85:15, and can preferably include a total amount of the ruthenium, iridium, and titanium to the amount of platinum in a molar ratio of 95:5 to 85:15.

When the above-described range is satisfied, the overvoltage phenomenon of the anode during electrolysis, the durability of the anode, and the stability of the catalyst layer can be significantly improved. Also, the generation of the oxygen at the anode during electrolysis can be significantly suppressed.

The ruthenium included in the composite metal oxide can achieve excellent catalytic activity in a chlorine oxidation reaction.

The ruthenium can be included in an amount from 20 mol % to 35 mol % or 25 mol % to 30 mol % based on a total mole of metal components in the composite metal oxide, and can preferably be included in an amount from 25 mol % to 30 mol %.

When the above-described range is satisfied, the ruthenium can achieve significantly excellent catalytic activity in the chlorine oxidation reaction.

The iridium included in the composite metal oxide can help the catalytic activity of the ruthenium.

The iridium can be included in an amount from 10 mol % to 25 mol % or 15 mol % to 22 mol % based on the total mole of the metal components in the composite metal oxide, and can preferably be included in an amount from 15 mol % to 22 mol %.

When the above-described range is satisfied, the iridium can not only help the catalytic activity of the ruthenium, but can also suppress decomposition or corrosion dissolution of oxide particles during electrolysis.

The titanium included in the composite metal oxide can help the catalytic activity of the ruthenium.

The titanium can be included in an amount from 35 mol % to 60 mol % or 40 mol % to 55 mol % based on the total mole of the metal components in the composite metal oxide, and can preferably be included in an amount from 40 mol % to 55 mol %.

When the above-described range is satisfied, the titanium can not only help the catalytic activity of the ruthenium, but can also further suppress the decomposition or corrosion dissolution of the oxide particles during electrolysis.

The platinum can be included in an amount from 2 mol % to 20 mol % or 5 mol % to 15 mol % based on the total mole of the metal components in the composite metal oxide, and can preferably be included in an amount from 5 mol % to 15 mol %.

When the above-described range is satisfied, the overvoltage phenomenon of the anode during electrolysis, the durability of the anode, and the stability of the catalyst layer can be significantly improved. Also, the generation of the oxygen at the anode during electrolysis can be significantly suppressed.

The catalyst layer can specifically be characterized in that the composite metal oxide does not include a palladium oxide.

It is controlled so that palladium is not present as the metal component in the catalyst layer, wherein, with respect to the palladium, since an amount of the palladium dissolved after the formation of the electrode catalyst layer is greater than that of the platinum, there is a concern that the durability of the electrode is greatly reduced, and selectivity for oxygen generation is high.

The anode for electrolysis according to an embodiment of the present invention can be used as an electrolysis electrode of an aqueous solution containing chloride, particularly, an anode. The aqueous solution containing chloride can be an aqueous solution containing sodium chloride or potassium chloride.

Also, the anode for electrolysis according to the embodiment of the present invention can be used as an anode for preparing hypochlorite or chlorine. For example, the anode for electrolysis can generate hypochlorite or chlorine by being used as an anode for brine electrolysis.

2. Method of Preparing Anode for Electrolysis.

A method of preparing an anode for electrolysis according to another embodiment of the present invention includes a coating step in which a composition for forming a catalyst layer is coated on at least one surface of a metal base, dried, and heat-treated, wherein the coating is conducted by electrostatic spray deposition, and the composition for forming a catalyst layer includes a ruthenium-based compound, an iridium-based compound, a titanium-based compound, and a platinum-based compound.

The coating step is a step for preparing an anode for electrolysis by forming a catalyst layer on at least one surface of a metal base, wherein it can be performed by coating the at least one surface of the metal base with the composition for forming a catalyst layer, drying, and performing heat treatment.

The coating is conducted by electrostatic spray deposition.

The electrostatic spray deposition is a method in which fine coating liquid particles charged by a constant current are coated on a substrate, wherein a spray nozzle is mechanically controlled to be able to spray the composition for forming a catalyst layer on at least one surface of the metal base at a constant rate, and thus, the composition for forming a catalyst layer is uniformly distributed on the metal base.

The coating is conducted by electrostatic spray deposition, wherein the composition for forming a catalyst layer can be sprayed on the metal base in an amount per spray of 100 mL to 250 mL, for example, 130 mL to 220 mL at a rate of 5 mL/min to 10 mL/min, for example, 6 mL/min to 9 mL/min.

When the above-described condition is satisfied, an appropriate amount of the composition for forming a catalyst layer can be more uniformly coated on the metal base.

In this case, the amount per spray is an amount required to spray both sides of the metal base once, and the coating can be performed at room temperature.

If a voltage of the nozzle is low when the electrostatic spray deposition is performed, an electrostatic effect is reduced so that coating liquid drops are aggregated and coating efficiency is reduced, but, if the voltage is high, there is a limitation in that the coating liquid drops are dried quickly while the coating liquid drops excessively break to deteriorate the durability of the coating layer, and thus, an appropriate level of voltage is very important.

Thus, the voltage of the nozzle can be in a range of 10 V to 30 V, for example, 15 V to 25 V. When the above-described condition is satisfied, coating uniformity and durability can be further improved.

In general, an anode for electrolysis is prepared by forming a catalyst layer containing an anodic reaction active material on a metal base, and, in this case, the catalyst layer is formed by coating a composition for forming the catalyst layer containing the active material on the metal base, drying, and performing a heat treatment.

In this case, the coating can typically be performed by doctor blading, die casting, comma coating, screen printing, spray coating, roller coating, and brushing, wherein, in this case, a uniform distribution of the active material on the metal base is difficult, the active material may not be uniformly distributed in the catalyst layer of the anode thus prepared, and, as a result, activity of the anode can be reduced or lifetime can be reduced.

Also, previously, electrostatic spray deposition was not used for reasons such as coating efficiency, and it is substantially difficult to satisfy characteristics of various aspects, such as uniformity of the catalyst layer and coating efficiency, by the electrostatic spray deposition.

However, in the method of preparing an anode for electrolysis according to the another embodiment of the present invention, since the composition for forming a catalyst layer is coated on the metal base by the electrostatic spray deposition instead of the conventional method, an anode can be prepared in which the active material is uniformly distributed in the catalyst layer, and with respect to the anode for electrolysis prepared by the method, the overvoltage can not only be reduced, but also the lifetime can be improved and the oxygen generation can be suppressed. Furthermore, the reason for which the electrostatic spray deposition can be particularly suitable as described above is due to the optimization of the voltage of the nozzle and the spray amount during electrostatic spraying, wherein the electrostatic spray deposition can be an optimized method for the preparation method according to the embodiment of the present invention.

The preparation method can include a step of performing a pretreatment of the metal base before the composition for forming a catalyst layer is coated on the at least one surface of the metal base. The pretreatment can include the formation of irregularities on the surface of the metal base by chemical etching, blasting or thermal spraying.

The pretreatment can be performed by blasting the surface of the metal base to form fine irregularities, and performing a salt treatment or an acid treatment. For example, the pretreatment can be performed in such a manner that the surface of the metal base is blasted with alumina to form irregularities, immersed in a sulfuric acid aqueous solution, washed, and dried.

The ruthenium-based compound can include at least one selected from the group consisting of ruthenium hexafluoride ($RuF_6$), ruthenium (III) chloride ($RuCl_3$), ruthenium (III) chloride hydrate ($RuCl_3.xH_2O$), ruthenium (III) bromide ($RuBr_3$), ruthenium (III) bromide hydrate ($RuBr_3.xH_2O$), ruthenium iodide ($RuI_3$), and ruthenium acetate, and, among them, the ruthenium (III) chloride hydrate is preferable.

The iridium-based compound can include at least one selected from the group consisting of iridium chloride ($IrCl_3$), iridium chloride hydrate ($IrCl_3.xH_2O$), potassium hexachloroiridate ($K_2IrCl_6$), and potassium hexachloroiridate hydrate ($K_2IrCl_6.xH_2O$), and, among them, the iridium chloride is preferable.

The titanium-based compound can be titanium alkoxide, wherein the titanium alkoxide can include at least one selected from the group consisting of titanium isopropoxide ($Ti[OCH(CH_3)_2]_4$) and titanium butoxide ($Ti(OCH_2CH_2CH_2CH_3)_4$), and, among them, the titanium isopropoxide is preferable.

The platinum-based compound can include at least one selected from the group consisting of chloroplatinic acid hexahydrate ($H_2PtCl_6.6H_2O$), platinum acetylacetonate ($C_{10}H_{14}O_4Pt$), and ammonium hexachloroplatinate ($[NH_4]_2PtCl_6$), and, among them, the chloroplatinic acid hexahydrate is preferable.

The composition for forming a catalyst layer can further include an alcohol-based solvent. The alcohol-based solvent can include lower alcohols and, among them, n-butanol is preferable.

The drying can be performed at 50° C. to 200° C. for 5 minutes to 60 minutes, and can preferably be performed at 50° C. to 100° C. for 5 minutes to 20 minutes.

When the above-described condition is satisfied, energy consumption can be minimized while the solvent can be sufficiently removed.

The heat treatment can be performed at 400° C. to 600° C. for 1 hour or less, and can preferably be performed at 450° C. to 500° C. for 10 minutes to 30 minutes.

When the above-described condition is satisfied, it may not affect the strength of the metal base while impurities in the catalyst layer are easily removed.

The coating can be performed by sequentially repeating coating, drying, and heat-treating so that an amount of ruthenium per unit area ($m^2$) of the metal base is 7.0 g or more. That is, after the composition for forming a catalyst layer is coated on at least one surface of the metal base, dried, and heat-treated, the preparation method according to the another embodiment of the present invention can be performed by repeatedly coating, drying, and heat-treating the one surface of the metal base which has been coated with the first composition for forming a catalyst layer.

Hereinafter, the present invention will be described in more detail according to examples and experimental examples, but the present invention is not limited to these examples and experimental examples. The invention can, however, be embodied in many different forms and should not be construed as being limited to the embodiments set forth herein. Rather, these example embodiments are provided so that this description will be thorough and complete, and will fully convey the scope of the present invention to those skilled in the art.

EXAMPLE 1

A titanium base was blasted with alumina to form irregularities on a surface thereof. The titanium base having the irregularities formed thereon was washed to remove oil and impurities. Fine irregularities were formed by immersing the washed titanium base in a sulfuric acid aqueous solution (concentration: 50 vol %) at 80° C. for 30 minutes. Subsequently, the titanium base was washed with distilled water and sufficiently dried to prepare a pretreated titanium base.

248 mmol of ruthenium chloride hydrate ($RuCl_3.xH_2O$), 184 mmol of iridium chloride hydrate ($IrCl_3.xH_2O$), 413 mmol of titanium isopropoxide ($Ti[OCH(CH_3)_2]_4$), 73 mmol of chloroplatinic acid hexahydrate ($H_2PtCl_6.6H_2O$), and 1,575 mL of n-butanol were mixed to prepare a composition for forming a catalyst layer. In this case, a molar ratio of ruthenium (Ru), iridium (Ir), titanium (Ti), and platinum (Pt) in the composition for forming a catalyst layer was about 27:20:45:8.

Both surfaces of the pretreated titanium base were coated with the composition for forming a catalyst layer. In this case, the coating was conducted by electrostatic spray deposition at room temperature, in which an amount of the composition per spray was 175 mL, a spray rate was 7 mL/min, and a voltage was 20 V.

After the coating, the coated titanium base was dried for 10 minutes in a convection drying oven at 70° C. and was then heat-treated for 10 minutes in an electric heating furnace at 480° C. In this case, the coating, drying, and heat treatment of the composition for forming a catalyst layer were repeated until an amount of ruthenium per unit area (1 $m^2$) of the titanium base was 7.0 g. The final heat treatment was performed at 480° C. for 1 hour to prepare an anode for electrolysis.

EXAMPLE 2

An anode for electrolysis was prepared in the same manner as in Example 1 except that 230 mmol of ruthenium chloride hydrate ($RuCl_3.xH_2O$), 184 mmol of iridium chloride hydrate ($IrCl_3.xH_2O$), 459 mmol of titanium isopropoxide ($Ti[OCH(CH_3)_2]_4$), 46 mmol of chloroplatinic acid hexahydrate ($H_2PtCl_6.6H_2O$), and 1,575 mL of n-butanol were mixed to prepare a composition for forming a catalyst layer.

In this case, a molar ratio of Ru, Ir, Ti, and Pt in the composition for forming a catalyst layer was about 25:20:50:5.

EXAMPLE 3

An anode for electrolysis was prepared in the same manner as in Example 1 except that 230 mmol of ruthenium chloride hydrate ($RuCl_3.xH_2O$), 138 mmol of iridium chloride hydrate ($IrCl_3.xH_2O$), 505 mmol of titanium isopropoxide ($Ti[OCH(CH_3)_2]_4$). 46 mmol of chloroplatinic acid hexahydrate ($H_2PtCl_6.6H_2O$), and 1,575 mL of n-butanol were mixed to prepare a composition for forming a catalyst layer.

In this case, a molar ratio of Ru, Ir, Ti, and Pt in the composition for forming a catalyst layer was about 25:15:55:5.

EXAMPLE 4

An anode for electrolysis was prepared in the same manner as in Example 1 except that 248 mmol of ruthenium chloride hydrate ($RuCl_3.xH_2O$), 184 mmol of iridium chloride hydrate ($IrCl_3.xH_2O$), 449.5 mmol of titanium isopropoxide ($Ti[OCH(CH_3)_2]_4$), 36.5 mmol of chloroplatinic acid hexahydrate ($H_2PtCl_6.6H_2O$), and 1,575 mL of n-butanol were mixed to prepare a composition for forming a catalyst layer.

In this case, a molar ratio of Ru, Ir, Ti, and Pt in the composition for forming a catalyst layer was about 27:20:49:4.

EXAMPLE 5

An anode for electrolysis was prepared in the same manner as in Example 1 except that 248 mmol of ruthenium chloride hydrate ($RuCl_3.xH_2O$), 184 mmol of iridium chloride hydrate ($IrCl_3.xH_2O$), 431.25 mmol of titanium isopropoxide ($Ti[OCH(CH_3)_2]_4$). 54.75 mmol of chloroplatinic acid hexahydrate ($H_2PtCl_6.6H_2O$), and 1,575 mL of n-butanol were mixed to prepare a composition for forming a catalyst layer.

In this case, a molar ratio of Ru, Ir, Ti, and Pt in the composition for forming a catalyst layer was about 27:20:47:6.

COMPARATIVE EXAMPLE 1

An anode for electrolysis was prepared in the same manner as in Example 1 except that 322 mmol of ruthenium chloride hydrate ($RuCl_3.xH_2O$), 184 mmol of iridium chloride hydrate ($IrCl_3.xH_2O$). 413 mmol of titanium isopropoxide ($Ti[OCH(CH_3)_2]_4$), and 1,575 mL of n-butanol were mixed to prepare a composition for forming a catalyst layer.

In this case, a molar ratio of Ru, Ir, and Ti in the composition for forming a catalyst layer was about 35:20:45.

COMPARATIVE EXAMPLE 2

An anode for electrolysis was prepared in the same manner as in Example 1 except that 248 mmol of ruthenium chloride hydrate ($RuCl_3.xH_2O$), 184 mmol of iridium chloride hydrate ($IrCl_3.xH_2O$), 413 mmol of titanium isopropoxide ($Ti[OCH(CH_3)_2]_4$), 73 mmol of palladium chloride ($PdCl_2$), and 1,575 mL of n-butanol were mixed to prepare a composition for forming a catalyst layer.

In this case, a molar ratio of Ru, Ir, Ti, and Pd in the composition for forming a catalyst layer was about 27:20:45:8.

COMPARATIVE EXAMPLE 3

An anode for electrolysis was prepared in the same manner as in Example 1 except that a brush coating method was performed when both surfaces of the pretreated titanium base were coated with the composition for forming a catalyst layer.

COMPARATIVE EXAMPLE 4

An anode for electrolysis was prepared in the same manner as in Example 2 except that a brush coating method was performed when both surfaces of the pretreated titanium base were coated with the composition for forming a catalyst layer.

COMPARATIVE EXAMPLE 5

An anode for electrolysis was prepared in the same manner as in Example 3 except that a brush coating method was performed when both surfaces of the pretreated titanium base were coated with the composition for forming a catalyst layer.

COMPARATIVE EXAMPLE 6

An anode for electrolysis was prepared in the same manner as in Example 4 except that a brush coating method was performed when both surfaces of the pretreated titanium base were coated with the composition for forming a catalyst layer.

COMPARATIVE EXAMPLE 7

An anode for electrolysis was prepared in the same manner as in Example 5 except that a brush coating method was performed when both surfaces of the pretreated titanium base were coated with the composition for forming a catalyst layer.

EXPERIMENTAL EXAMPLE 1

Evaluation of Uniformity of Electrode Composition

A degree of distribution of metal in the catalyst layer of each anode for electrolysis of the examples and comparative examples was analyzed, and the results thereof are presented in Table 1 below.

Specifically, each anode was fabricated to have a size of 1.2 m in length and 1.2 m in width, it was equally divided into 9 pixels, and a wt % of iridium in each pixel was then measured using an X-ray fluorescence (XRF) analyzer.

Thereafter, a mean value and dispersion were obtained by using each iridium wt % obtained, and a standard deviation was obtained by using the dispersion.

TABLE 1

| Category | The number of coating repetitions (number of times) | Coating method | Ir mean value (wt %) | Ir standard deviation | Ir standard deviation/ Ir mean value |
|---|---|---|---|---|---|
| Example 1 | 6 | Electrostatic spray deposition | 3.18 | 0.260 | 0.0818 |
| Example 2 | 6 | Electrostatic spray deposition | 2.94 | 0.288 | 0.0653 |
| Example 3 | 6 | Electrostatic spray deposition | 2.29 | 0.205 | 0.0896 |
| Example 4 | 6 | Electrostatic spray deposition | 3.11 | 0.235 | 0.0757 |
| Example 5 | 6 | Electrostatic spray deposition | 3.07 | 0.212 | 0.0691 |
| Comparative Example 1 | 6 | Electrostatic spray deposition | 2.83 | 0.210 | 0.0742 |

TABLE 1-continued

| Category | The number of coating repetitions (number of times) | Coating method | Ir mean value (wt %) | Ir standard deviation | Ir standard deviation/ Ir mean value |
|---|---|---|---|---|---|
| Comparative Example 2 | 6 | Electrostatic spray deposition | 2.92 | 0.216 | 0.0740 |
| Comparative Example 3 | 6 | Brush coating | 3.11 | 0.650 | 0.2090 |
| Comparative Example 4 | 6 | Brush coating | 2.81 | 0.611 | 0.2176 |
| Comparative Example 5 | 6 | Brush coating | 2.07 | 0.457 | 0.2208 |
| Comparative Example 6 | 6 | Brush coating | 2.67 | 0.569 | 0.2132 |
| Comparative Example 7 | 6 | Brush coating | 3.24 | 0.630 | 0.1945 |

Referring to Table 1, with respect to Examples 1 to 5, since the standard deviations of iridium compositions were smaller than those of Comparative Examples 3 to 7 in which the coating method was only different, the coating method greatly affected the standard deviation of the iridium compositions of the anode for electrolysis, and, as a result, the electrodes prepared in Examples 1 to 5 had significantly better composition uniformity than the comparative examples.

EXPERIMENTAL EXAMPLE 2

Evaluation of Coating Loading

In order to comparatively analyze performances of the anodes for electrolysis of the examples and the comparative examples, weights before and after the coating of the electrode were measured using a half-cell to measure a coating loading, and the results thereof are presented in Table 2 below.

Herein, with respect to the half-cell, a NaCl aqueous solution (305 g/L) and HCl (4.13 mM) were used as an electrolyte, the anodes of the examples and the comparative examples were used, a Pt wire was used as a counter electrode, and an SCE (KCl Saturated electrode) was used as a reference electrode. Then, the anode and the counter electrode were immersed in the electrolyte at 90° C., the reference electrode was immersed in the electrolyte at room temperature, and the electrolyte at 90° C. and the electrolyte at room temperature were connected via a salt bridge.

TABLE 2

| Category | $g_{cat}/m^2$ |
|---|---|
| Example 1 | 22.9 |
| Example 2 | 23.3 |
| Example 3 | 22.9 |
| Example 4 | 23.2 |
| Example 5 | 22.6 |
| Comparative Example 1 | 23.1 |
| Comparative Example 2 | 23.2 |
| Comparative Example 3 | 22.7 |
| Comparative Example 4 | 23.3 |
| Comparative Example 5 | 24.3 |
| Comparative Example 6 | 22.8 |
| Comparative Example 7 | 22.4 |

Examples 1 to 5 had the same level of coating loading as Comparative Examples 1 to 7. From these results, the coating loading was not affected even if the components of the composition for forming a catalyst layer and the coating method were different.

EXPERIMENTAL EXAMPLE 3

Overvoltage Evaluation 1

A voltage of the anode of the half-cell, which includes each of the anodes for electrolysis of the examples and the comparative examples, was measured at a current density of 4.4 kA/$m^2$ by constant current chronopotentiometry.

Also, in order to compare a relative degree of each voltage value, the anode voltage value of the half-cell of Comparative Example 1 was set as a reference value of 100, and the measured voltage values of the remaining examples and comparative examples were indexed. Specifically, a value of (fractional value of the voltage measured in Comparative Example 1)/(fractional value of the voltage measured in each example or comparative Example)*100 was defined as an index value. The measured voltage values and the calculated index values are summarized in Table 3 below.

Herein, a method of preparing the half-cell is as described in Experimental Example 2.

TABLE 3

| Category | Voltage (V) | Index |
|---|---|---|
| Example 1 | 1.235 | 114.043 |
| Example 2 | 1.235 | 114.043 |
| Example 3 | 1.234 | 114.530 |
| Example 4 | 1.235 | 114.043 |
| Example 5 | 1.236 | 113.559 |
| Comparative Example 1 | 1.268 | 100.000 |
| Comparative Example 2 | 1.246 | 108.943 |

Referring to Table 3, the standard deviations of the iridium compositions of Examples 1 to 5 were the same level as those of Comparative Examples 1 and 2, but, since Examples to 5 included platinum, the overvoltage phenomenon was improved in comparison to Comparative Examples 1 and 2.

EXPERIMENTAL EXAMPLE 4

Electrolysis was performed for 1 hour at a current density of 6.2 A/$cm^2$ on a counter electrode of a single cell including each of the anodes for electrolysis of the examples and comparative examples, amounts of a platinum or palladium component in the anode before and after the electrolysis were measured by XRF analysis using the Delta professional (instrument name, manufacturer: Olympus), and the results thereof are listed in Table 4 below.

Herein, the single cell was prepared by using each of the anodes of the examples and comparative examples, a NaCl aqueous solution (23.4 wt %) as an anode electrolyte, a Ni electrode coated with $RuO_2$—$CeO_2$ as a counter electrode, and a NaOH aqueous solution (30.5 wt %) as a cathode electrolyte.

During the XRF analysis, a 4W Rh anode X-ray tube was used as an excitation source, a silicon drift detector was used as a detector, and single beam exposure time was 30 seconds.

TABLE 4

| Category | Example 1 | | Example 2 | | Example 3 | | Example 4 | | Comparative Example 2 | |
|---|---|---|---|---|---|---|---|---|---|---|
| | Before | After | Before | After | Before | After | Before | After | Before | After |
| Platinum | 1.48 | 1.54 | 0.867 | 0.907 | 0.863 | 0.908 | 0.752 | 0.809 | — | — |
| Palladium | — | — | — | — | — | — | — | — | 0.186 | 0.117 |
| Rate of change | 1.041 | | 1.046 | | 1.052 | | 1.076 | | 0.629 | |

Referring to Table 4, with respect to the platinum of the examples, the amounts before and after the electrolysis were the same or there was a relative increase in the amount of the platinum due to dissolution of other components, but, with respect to Comparative Example 2 in which the palladium was used, the amount of the palladium was reduced due to dissolution during the electrolysis. That is, in a case in which the palladium was used as a component of the catalyst layer, loss of the metal in the catalyst layer occurred due to the dissolution, and, as a result, performance degradation and durability deterioration can occur.

EXPERIMENTAL EXAMPLE 5

Overvoltage Evaluation 2

A voltage of the anode of the single cell, which includes each of the anodes for electrolysis of the examples and the comparative examples, was measured at a current density of 6.2 kA/$m^2$ by using constant-current electrolysis, the measured voltages were indexed as in Experimental Example 3, and the results thereof are presented in Table 5.

Herein, the single cell was prepared by using each of the anodes of the examples and comparative examples, a NaCl aqueous solution (23.4 wt %) as an anode electrolyte, a Ni electrode coated with $RuO_2$—$CeO_2$ as a counter electrode, and a NaOH aqueous solution (30.5 wt %) as a cathode electrolyte.

TABLE 5

| Category | Voltage (V) | Index |
|---|---|---|
| Example 1 | 3.045 | 208.889 |
| Example 2 | 3.020 | 470.000 |
| Example 3 | 3.040 | 235.000 |
| Example 4 | 3.042 | 223.810 |
| Example 5 | 3.037 | 254.054 |
| Comparative Example 1 | 3.094 | 100.000 |
| Comparative Example 2 | 3.060 | 156.667 |
| Comparative Example 3 | 3.065 | 144.615 |
| Comparative Example 4 | 3.060 | 156.667 |
| Comparative Example 5 | 3.045 | 208.889 |
| Comparative Example 6 | 3.061 | 154.098 |
| Comparative Example 7 | 3.054 | 174.074 |

Referring to Table 5, Example 1 had an improvement in the overvoltage phenomenon in comparison to Comparative Example 3, Example 2 had an improvement in the overvoltage phenomenon in comparison to Comparative Example 4, Example 3 had an improvement in the overvoltage phenomenon in comparison to Comparative Example 5, Example 4 had an improvement in the overvoltage phenomenon in comparison to Comparative Example 6, Example 5 had an improvement in the overvoltage phenomenon in comparison to Comparative Example 7, and Examples 1 to 5 had an improvement in the overvoltage phenomenon in comparison to Comparative Examples 1 and 2.

EXPERIMENTAL EXAMPLE 6

Evaluation of Oxygen Selectivity

Oxygen selectivity, that is, an amount of oxygen generated of the anode of the single cell prepared in Experimental Example 5 was measured at a current density of 6.2 kA/$m^2$ by using constant-current electrolysis, the measured oxygen selectivities were indexed as in Experimental Example 3, and the results thereof are presented in Table 6.

TABLE 6

| Category | Oxygen selectivity (mol %) | Index |
|---|---|---|
| Example 1 | 0.47 | 148.936 |
| Example 2 | 0.60 | 116.667 |
| Example 3 | 0.63 | 111.111 |
| Example 4 | 0.73 | 95.890 |
| Example 5 | 0.70 | 100.000 |
| Comparative Example 1 | 0.70 | 100.000 |
| Comparative Example 2 | 1.10 | 63.636 |
| Comparative Example 3 | 0.70 | 100.000 |
| Comparative Example 4 | 0.75 | 93.333 |
| Comparative Example 5 | 0.72 | 97.222 |
| Comparative Example 6 | 1.17 | 59.829 |
| Comparative Example 7 | 1.04 | 67.308 |

Referring to Table 6, Example 1 had an improvement in the oxygen selectivity in comparison to Comparative Example 3, Example 2 had an improvement in the oxygen selectivity in comparison to Comparative Example 4, Example 3 had an improvement in the oxygen selectivity in comparison to Comparative Example 5, Example 4 had an improvement in the oxygen selectivity in comparison to Comparative Example 6, Example 5 had an improvement in the oxygen selectivity in comparison to Comparative Example 7, and Examples 1 to 5 had an improvement in the oxygen selectivity in comparison to Comparative Examples 1 and 2.

EXPERIMENTAL EXAMPLE 7

Durability Evaluation

Durability of each anode for electrolysis of the examples and comparative examples was measured by a method described below, and the results thereof are presented in Table 7.

Durability measurement method: 1 M $Na_2SO_4$ was used as an electrolyte, a Pt wire was used as a counter electrode, and each of the anodes of the examples and comparative examples was used as an anode, and voltage rise time of the anode was measured at a current density of 40 kA/$m^2$ and room temperature.

TABLE 7

| Category | Time (hour) |
|---|---|
| Example 1 | >90 |
| Example 4 | >90 |
| Example 5 | >90 |
| Comparative Example 1 | 47 |
| Comparative Example 2 | 40 |
| Comparative Example 3 | 75 |
| Comparative Example 6 | 80 |
| Comparative Example 7 | 62 |

Referring to Table 7, Example 1 had an improvement in the anode durability in comparison to Comparative Example 3, Example 4 had an improvement in the anode durability in comparison to Comparative Example 6, Example 5 had an improvement in the anode durability in comparison to Comparative Example 7, and Examples 1, 4, and 5 had an improvement in the anode durability in comparison to Comparative Examples 1 and 2.

The invention claimed is:

1. An anode for electrolysis, the anode comprising:

a metal base; and a catalyst layer disposed on at least one surface of the metal base, wherein:

the catalyst layer comprises a composite metal oxide of ruthenium, iridium, titanium, and platinum;

the catalyst layer does not include palladium as a metal component;

the anode does not include palladium; and a standard deviation of iridium compositions of a plurality of equally divided pixels of the catalyst layer is 0.4 or less.

2. The anode of claim 1, wherein the standard deviation of iridium compositions is 0.30 or less.

3. The anode of claim 1, wherein a standard deviation value of the iridium compositions with respect to a mean value of the iridium compositions of the plurality of divided pixels (standard deviation/mean) is in a range of 0.05 to 0.15.

4. The anode of claim 1, wherein the catalyst layer comprises 7.0 g or more of ruthenium per unit area ($m^2$) of the catalyst layer.

5. The anode of claim 1, wherein the composite metal oxide comprises a total amount of the ruthenium, the iridium, and the titanium to the amount of platinum in a molar ratio of 98:2 to 80:20.

6. The anode of claim 1, wherein the composite metal oxide comprises:

20 mol % to 35 mol % of the ruthenium;

10 mol % to 25 mol % of the iridium;

35 mol % to 60 mol % of the titanium; and 2 mol % to 20 mol % of the platinum, based on a total mole of metal components in the composite metal oxide.

7. The anode of claim 1, wherein the metal base comprises titanium, tantalum, aluminum, hafnium, nickel, zirconium, molybdenum, tungsten, stainless steel, or an alloy thereof.

* * * * *